US011208875B2

(12) United States Patent
Sodowsky et al.

(10) Patent No.: US 11,208,875 B2
(45) Date of Patent: Dec. 28, 2021

(54) METHOD OF CONDUCTING PLUNGER LIFT OPERATIONS USING A SPHERE AND SLEEVE PLUNGER COMBINATION

(71) Applicant: ExxonMobil Upstream Research Company, Spring, TX (US)

(72) Inventors: Jason T. Sodowsky, Cashion, OK (US); Harold Douglas Selby, London, AR (US); Kirk B. Ross, Shidler, OK (US)

(73) Assignee: ExxonMobil Upstream Research Company, Spring, TX (US)

( * ) Notice: Subject to any disclaimer, the term of this patent is extended or adjusted under 35 U.S.C. 154(b) by 36 days.

(21) Appl. No.: 16/666,369

(22) Filed: Oct. 28, 2019

(65) Prior Publication Data

US 2020/0217178 A1 Jul. 9, 2020

Related U.S. Application Data

(60) Provisional application No. 62/852,526, filed on May 24, 2019, provisional application No. 62/788,520, filed on Jan. 4, 2019.

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; F04B 47/12
See application file for complete search history.

(56) References Cited

U.S. PATENT DOCUMENTS 1,932,453 A * 10/1933 Evans ..... F04B 47/12 417/56
2,001,012 A * 5/1935 Burgher ..... E21B 43/121 417/60

(Continued)

FOREIGN PATENT DOCUMENTS

EP 2 077 374 A1 7/2009
GB 2 393 747 A 4/2004

(Continued)

OTHER PUBLICATIONS

Luan, et al., "A New Model for the Accurate Prediction of Liquid Loading in Low-Pressure Gas Wells," Journal of Canadian Petroleum Technology, pp. 493-498, Nov. 2012.

(Continued)

*Primary Examiner* — D. Andrews
(74) *Attorney, Agent, or Firm* — Leandro Arechederra, III

(57) ABSTRACT

A method of lifting liquids from a formation using a plunger lift assembly. The method includes dropping a multi-component plunger lift assembly from a wellhead and into a wellbore. This is done in response to a release signal or in response to a wellhead being shut in. The wellbore has a deviated section which may extend to horizontal. The multi-component plunger lift assembly includes a cylindrical plunger and a sphere. These components are released into the wellbore simultaneously. In response to reservoir formation gases passing into the wellbore, the method also includes allowing the plunger lift assembly to move up the wellbore and to the wellhead, thereby pushing liquids upwardly towards the wellhead.

20 Claims, 14 Drawing Sheets

(56) References Cited

U.S. PATENT DOCUMENTS

| | | | | |
|---|---|---|---|---|
| 6,148,923 | A * | 11/2000 | Casey | E21B 43/121 166/329 |
| 6,328,102 | B1 | 12/2001 | Dean | |
| 7,111,675 | B2 | 9/2006 | Zisk, Jr. | |
| 7,322,803 | B2 | 1/2008 | Vogeley | |
| 7,484,940 | B2 | 2/2009 | O'Niell | |
| 7,597,150 | B2 | 10/2009 | Clem | |
| 8,133,041 | B2 | 3/2012 | Ludlow et al. | |
| 8,220,533 | B2 | 7/2012 | Longfield et al. | |
| 8,511,390 | B2 | 8/2013 | Coyle et al. | |
| 9,903,186 | B2 | 2/2018 | Zimmerman, Jr. | |
| 9,976,548 | B2 | 5/2018 | Zimmerman, Jr. | |
| 2002/0197174 | A1 | 12/2002 | Howard | |
| 2003/0010491 | A1 | 1/2003 | Collette | |
| 2005/0161223 | A1* | 7/2005 | Shulyatikov | F04B 47/12 166/372 |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0023606 | A1 | 10/2012 | Bouldin et al. | |
| 2015/0000761 | A1* | 1/2015 | Jefferies | E21B 34/08 137/15.08 |
| 2015/0275633 | A1* | 10/2015 | Tolman | E21B 43/122 166/253.1 |
| 2015/0322753 | A1 | 11/2015 | Zimmerman, Jr. | |
| 2018/0003013 | A1 | 1/2018 | Jackson | |
| 2018/0238321 | A1 | 8/2018 | Zimmerman, Jr. | |

FOREIGN PATENT DOCUMENTS

| | | | |
|---|---|---|---|
| GB | 2 403 752 | A | 1/2005 |
| WO | WO 01/20126 | A2 | 3/2001 |
| WO | WO 2009/077714 | | 6/2009 |
| WO | WO 2011/079218 | A2 | 6/2011 |

OTHER PUBLICATIONS

IPS, Superior Energy Services, "The Sphere,"retrieved from http://ipsplungerlift.com/featured-downloads/ips-sphere-plunger-cutsheet.pdf, 2019, 1 page.

* cited by examiner

METHOD OF CONDUCTING PLUNGER LIFT OPERATIONS USING A SPHERE AND SLEEVE PLUNGER COMBINATION

CROSS REFERENCE TO RELATED APPLICATION

This application claims the benefit of U.S. Provisional Application 62/852,526 filed May 24, 2019 entitled "Method of Conducting Plunger Lift Operations Using a Sphere and Sleeve Plunger Combination," which is related to and claims the benefit of U.S. Ser. No. 62/788,520, entitled "Plunger Lift Systems and Methods" filed Jan. 4, 2019, the entireties of which are incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to artificial lift systems for a hydrocarbon-producing wellbore. Further still, the invention relates to plunger lift operations for lifting wellbore fluids to the surface.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

To prepare the wellbore for the production of hydrocarbon fluids, a string of tubing is run into the casing. The tubing becomes a string of production pipe through which hydrocarbon fluids flow from the reservoir and up to the surface.

Some wellbores are completed primarily for the production of gas (or compressible hydrocarbon fluids), as opposed to oil. Other wellbores initially produce hydrocarbon fluids, but over time transition to the production of primarily gas. In either of such wellbores, the formation will frequently produce fluids in both gas and liquid phases. Liquids may include water, oil and condensate while gas may include methane, ethane and other hydrocarbon components.

At the beginning of production, the formation pressure is typically capable of driving the liquids with the gas up the wellbore and to the surface. Liquid fluids will travel up to the surface through the production tubing, primarily in the form of entrained droplets. During the life of the well, the natural reservoir pressure will decrease as gases and liquids are removed from the formation. As the natural downhole pressure of the well decreases, the gas velocity moving up the well drops below a so-called critical flow velocity. See G. Luan and S. He, A New Model for the Accurate Prediction of Liquid Loading in Low-Pressure Gas Wells, *Journal of Canadian Petroleum Technology, p.* 493 (November 2012) for a discussion of mathematical models used for determining a critical gas velocity in a wellbore. In addition, the hydrostatic head of fluids in the wellbore will work against the formation pressure and block the flow of in situ gas into the wellbore. The result is that formation pressure is no longer able, on its own, to force fluids from the formation and up the production tubing in commercially viable quantities.

In response, various remedial measures have been taken by operators. One option is to simply reduce the inner diameter of the production tubing a small amount, thereby increasing pressure differential. Another option is through a so-called gas-lift system. Gas lift refers to a process wherein a gas (typically methane, ethane, nitrogen and related produced gas combinations) is injected into the casing of the wellbore, and then down to the production tubing. Gas injection may be done through gas-lift valves stacked vertically along the production tubing, or gas may simply be injected down the annulus to the bottom of the well and back up the production tubing. In either instance, the gas serves to lighten the density of the fluid column, reducing the hydrostatic head and decreasing the backpressure against the formation.

A related artificial lift technique that does not require continuous gas injection is referred to as plunger lift. Plunger lift production systems are typically used to deliquefy gas wells (or wells that are gas dominated). More specifically, the systems are used to unload relatively small volumes of liquid (primarily water) and any associated sands that accumulate at the bottom of the wellbore, periodically carrying them to the surface. Plunger lift wells are typically used onshore in so-called mature fields.

Plunger lift systems employ a small plunger, or "piston," which travels vertically (up and down) along the production tubing within the wellbore. The plunger is similar in function to a pipeline pig, but is designed to force the hydrostatic head up the wellbore and to the surface in response to a build-up of reservoir pressure at the bottom of the well. In operation, the plunger is dropped from the wellhead and into the wellbore. This is typically done after a period of shut-in, where production fluids are allowed to accumulate downhole. The plunger eventually hits the liquid level downhole and falls through the liquid. A bumper spring at the bottom of the well (and below the liquid level) cushions the impact of the plunger.

Once the plunger reaches the spring, the wellhead is opened, permitting fluids to move to the surface. Gas flowing into the well accumulates at the level of the plunger, creating a differential pressure that pushes the plunger back up towards the wellhead. Formation liquids are then pushed ahead of the plunger and to the surface.

Plunger lift is problematic in horizontal gas wells. Horizontal wellbores typically include long horizontal portions that extend through the hydrocarbon bearing formation. In some wells, the horizontal portion extends in excess of 5,000 feet. Friction prevents elongated plungers from reaching bottom in highly deviated wells since the plunger tends to travel on the low side of the tubing. Typically, a combination of high deviation and friction causes the plunger to stop falling at approximately 65° to 70° from vertical. Thus, the plunger never even gets to the horizontal portion of the wellbore and may not even reach the liquid level. Wells with low flow rates and bottom hole pressures often do not have a static or producing liquid level that will rise to this 70° point in the tubing.

Recently, IPS Plunger Lift (now owned by Superior Energy Services, Inc.) suggested using a spherical plunger rather than an elongated, or missile-shaped plunger. This is discussed in U.S. Pat. No. 9,903,186 issued in 2018 to Integrated Production Services, Inc. The idea was that a ball-shaped plunger would fall through the liquid level and across the heel of a deviated production tubing more readily than the traditional missile-shaped plunger. Liquids will build up in the wellbore while the well is shut in. Then, when the well is opened back to flow the sphere will lift the liquids to the surface just like a missile-shaped plunger would do.

The inventors have tested this theory in the field without success. What has been found is that the liquids tend to by-pass the ball-shaped plunger as the plunger is lifted to the surface. This is true even when the ball-shaped plunger closely approximates the inner diameter of the production tubing. The result is that by the time the ball gets to the surface, the accumulated liquids have bypassed the ball and are not lifted to the well head. Stated another way, the ball failed to maintain an efficient seal with the tubing during the lifting process.

As an alternative, Integrated Production Services, Inc. has developed a separate plunger-lift concept, which is a so-called continuous plunger. The continuous plunger combines the use of a spherical ball with a cylindrical sleeve, wherein the ball fits within the sleeve. In operation, the ball is located below the sleeve and is separated from the sleeve at the surface, causing it to fall against well flow into the well. At the same time, the sleeve stays in the wellhead lubricator until the well is shut in. The sleeve is then allowed to fall into the wellbore behind the ball. Of note, the well may be immediately opened back up to flow after the sleeve is dropped. This is the basis for the term "continuous" plunger.

FIG. 1A is a perspective view of a continuous plunger 100 as disclosed in U.S. Patent Publ. No. 2018/0238321 filed by Superior Energy Services, L.L.C. of Houston, Tex. FIG. 1B is a separate perspective view of the plunger 100 wherein certain components are shown in exploded apart relation. The plunger 100 represents a continuous plunger having multiple components.

The plunger 100 of FIGS. 1A and 1B first includes a sleeve member 110. The sleeve member 110 defines a generally cylindrical body having an upper end 112 and a lower end 114. A bore 105 is formed between the upper 112 and lower 114 ends, forming an interior flow passage.

The sleeve member 110 also includes a seal assembly 115. The seal assembly 115 resides along an outer diameter of the sleeve member 110. The seal assembly 115 comprises a series of o-rings, stepped metal surfaces or other annular seals 115. The seal assembly 115 minimizes fluid by-pass as the plunger lift assembly 100 is raised up in the wellbore. Grooves 117 reside along the seal assembly 115. The grooves 117 are said to create a turbulent zone between the sleeve 110 and the inside of a production string (not shown), thereby restricting liquid flow on the outside of the sleeve 110.

A so-called flow restriction member 120 is also provided as part of the plunger 100.

In the arrangement of FIGS. 1A and 1B, the flow restriction member 120 is a spherical member, or ball. The ball 120 is releasably trapped within the bore 105 of the sleeve member 110 at the lower end 114.

The continuous plunger 100 also includes a retention system 130. The retention system 130 is designed to releasably secure the ball 120 along the inner bore 105. In the arrangement of FIGS. 1A and 1B, the retention system 130 is spring-loaded.

In the spring loaded embodiment of the retention system 130, a plurality of ball-shaped retractable pressure members 132 are configured to protrude inwardly from apertures 134 communicating with the inner surface 105 of the sleeve member 110. An inward bias or pressure is supplied by springs 136 contacting the outer surface of each of the ball shaped retractable pressure members 132. The springs 136 are held in place by a retaining ring 138 that is sized to fit into a groove 135 in the exterior surface of the sleeve 110. The sleeve 110 also includes an interior shoulder (shown in FIG. 7 of U.S. Patent Publ. No 2018/0238321) against which the ball 120 can seat when it is being retained in the interior opening 105 to sleeve 110.

During operation, and as described further in U.S. Patent Publ. No 2018/0238321, the ball 120 is first dropped into the wellbore. Preferably, the well is not shut in and some liquids and gases may be produced before the ball 120 is dropped or even while the ball 120 is falling. Note again that that ball 120 is significantly smaller than the production tubing so that it may later be captured within the bore 105 of the sleeve 110. Sometime after the ball 120 is dropped, the sleeve 110 is also dropped. Thus, the ball 120 and sleeve 110 gravitationally fall separately into the wellbore. Of interest, the diameter of the ball 120 is so small that it typically cannot rise up the well simply through wellbore pressure following shut-in. Instead, the system requires a bumper spring (shown at 28 in FIG. 1 of U.S. Patent Publ. No 2018/0238321) to catch the ball 120 and the sleeve as they fall into the wellbore.

Additional details concerning the plunger 100 are disclosed in U.S. Patent Publ. No 2018/0238321, which is incorporated herein in its entirety by reference. Such details include a "catcher assembly" (not shown in FIGS. 1A and 1B), which operates to dislodge the ball 120 from the inner bore 105 of the sleeve 100 once the assembly 100 reaches the wellhead.

The catcher is described as "[a]n important feature of the plunger lift assembly." (See Para. [0046]). (See also U.S. Pat. No. 9,976,548.)

A need exists for a plunger lift assembly that uses a sphere-plunger, but which is able to capture accumulated liquids in a highly deviated or even horizontal wellbore. Further, a need exists for a method of plunger-lift that uses a sphere, wherein the sphere is dimensioned to capture accumulated liquids on its way back up the wellbore by seating against a lower end of a sleeve, preventing by-pass of wellbore fluids.

BRIEF SUMMARY OF THE DISCLOSURE

A plunger lift system is first provided herein. The plunger lift system is designed for use in an artificial lift system. The artificial lift system, in turn, is used for the production of hydrocarbons from a well.

The plunger lift system first comprises a plunger. The plunger defines a cylindrical body having an upper end and an opposing lower end. A bore is formed along the cylindrical body between the upper and lower ends, forming an inner diameter—referred to as $ID_P$.

The plunger lift system also includes a seat. The seat resides at the lower end of the plunger. Preferably, the seat is fabricated from an elastomeric or ductile material, and forms a cylindrical body having an inner diameter. In one aspect, the inner diameter of the seat defines $ID_P$.

The plunger lift system further comprises a sphere. The sphere has a diameter $OD_2$, wherein $OD_2$ is greater than $ID_P$. The sphere is configured to land on the seat in response to gas pressure from below the plunger and below the sphere, forming a fluid seal. At the same time, the sphere may freely drop from the seat when the gas pressure is removed.

A method of lifting liquids from a formation using a plunger lift assembly is also provided herein. The method first comprises providing a wellbore. The wellbore includes a wellhead at a surface. At least one string of casing extends down from the wellhead. A production tubing string resides within the casing extending down to a subsurface formation. Of interest, the production tubing has an inner diameter ($ID_T$).

The wellbore has been formed for the purpose of producing hydrocarbon fluids to the surface in commercially viable quantities. Typically, the well will produce primarily hydrocarbon fluids that are compressible at surface conditions, e.g., methane and ethane, but there will are also be at least some hydrocarbon liquids, albeit in diminishing quantities.

The wellbore comprises a vertical section, a deviated section, and a heel. The heel provides for a curved transition from the vertical section to the deviated section. Preferably, the deviated section is substantially horizontal.

The method additionally includes providing a lubricator adjacent the wellhead. The lubricator is configured to releasably hold a cylindrical plunger and a flow restriction member. Preferably, the flow restriction member is a sphere. The plunger and sphere are held in place in the lubricator by wellbore pressure when the well is flowing.

Of interest, the cylindrical plunger has an inner diameter ($ID_P$). At the same time, the sphere has an outer diameter ($OD_S$). $ID_T$ is greater than $OD_S$, while $OD_S$ is greater than $ID_P$.

A controller may be provided with the wellhead. The controller is configured to send signals either in periodic time increments that are pre-set, or in response to pressure signals from the wellbore. The signals open and close a production valve at the wellhead. When the valve is open, the well is flowing; when the valve is closed; the well is shut in.

In response to a signal shutting in the wellhead to flow, the method includes releasing the cylindrical plunger and the sphere into the production tubing. This is done simultaneously, allowing the plunger and the sphere to gravitationally fall into the wellbore together. The plunger and the sphere will fall down to at least the heel.

In one aspect, the wellbore comprises a bumper assembly or other "No-Go" device along the deviated section. Upon being released from the lubricator and upon gravitationally falling into the wellbore, the sphere lands on the bumper assembly. The bumper assembly preferably includes a spring placed along casing in the horizontal section of the wellbore.

In one embodiment, the cylindrical plunger gravitationally falls in the wellbore to a position along the heel of the wellbore that is at least 45°, or alternatively at least 65°, from vertical. At the same time, the sphere gravitationally falls into the wellbore ahead of the plunger along the heel of the wellbore to a position that is at least 70° from vertical, and perhaps 90°. Preferably, the sphere gravitationally falls into the wellbore ahead of the plunger and down below a liquid level within the wellbore.

In response to reservoir formation gases passing into the wellbore, the method additionally includes pushing the sphere up the wellbore. As the sphere moves up the wellbore, the sphere pushes wellbore fluids ahead of it. Those fluids pass through the inner diameter ($ID_P$) of the cylindrical plunger until the sphere itself reaches the plunger. Preferably, the sphere lands on a seat at the bottom of the plunger, forming a seal.

The method additionally includes further pushing the sphere and cylindrical plunger up the production tubing and to the lubricator, together. This is done in response to formation pressure. As the sphere and plunger traverse up the production tubing, the accumulated liquids are pushed upwardly towards the wellhead ahead of the plunger. This, in turn, at least temporarily reduces a hydrostatic head in the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 4A is a side, cross-sectional view of a well site with a wellbore. A plunger lift system is installed over the wellbore. Here, a plunger lift assembly (not visible) resides in a lubricator at the well head.

FIG. 4B shows the plunger lift assembly having been released into a string of production tubing.

FIG. 4C shows that the sphere of the plunger lift assembly has traveled to an end sub along the production tubing. At the same time, the cylindrical plunger has stopped along the heel of the production tubing.

FIG. 4D shows the sphere being raised back up the wellbore in response to increased pressure from gas production. Accumulated liquids in the wellbore are being forced up the wellbore ahead of the sphere.

FIG. 4E shows that the sphere has landed on a bottom of the cylindrical plunger. The sphere, the plunger and the accumulated liquids are now moving up the wellbore together, towards the wellhead.

DETAILED DESCRIPTION OF CERTAIN EMBODIMENTS

Definitions

Figure 1A:
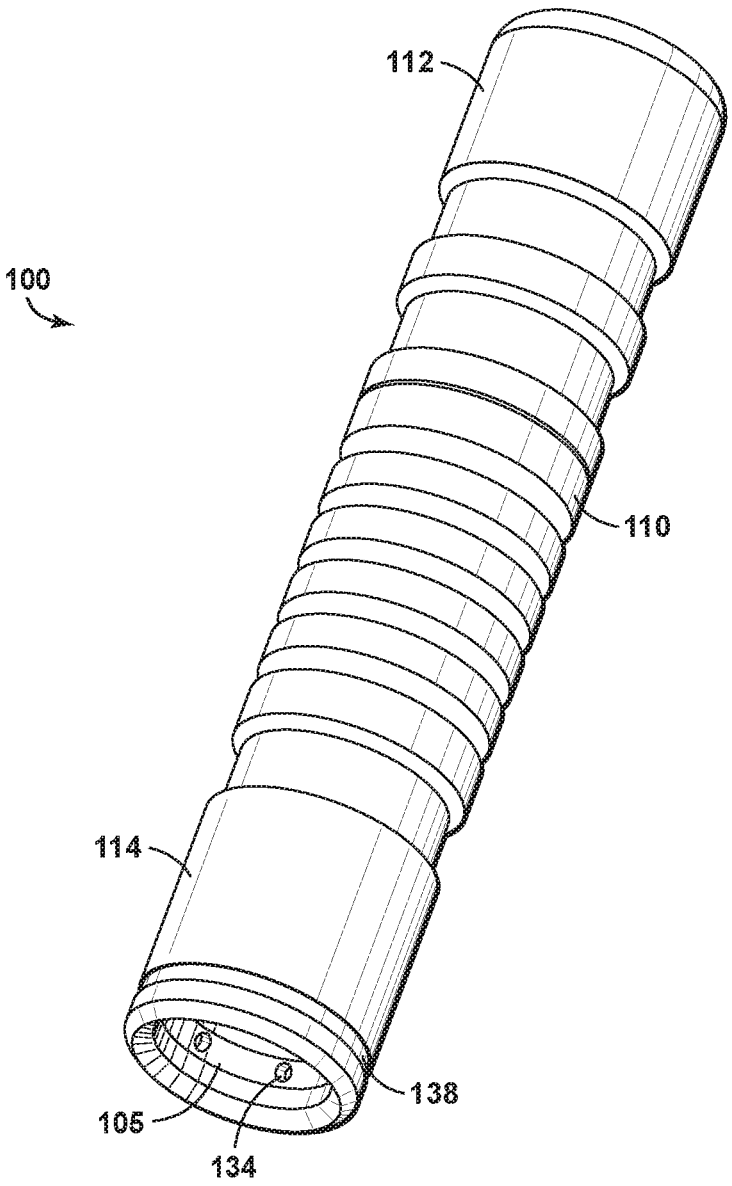
FIG. 1A (Prior Art)
FIG. 1A is a first perspective view of a known continuous plunger used for a plunger lift production operation. In this view, only a cylindrical sleeve of the continuous plunger is visible.
Figure 1B:
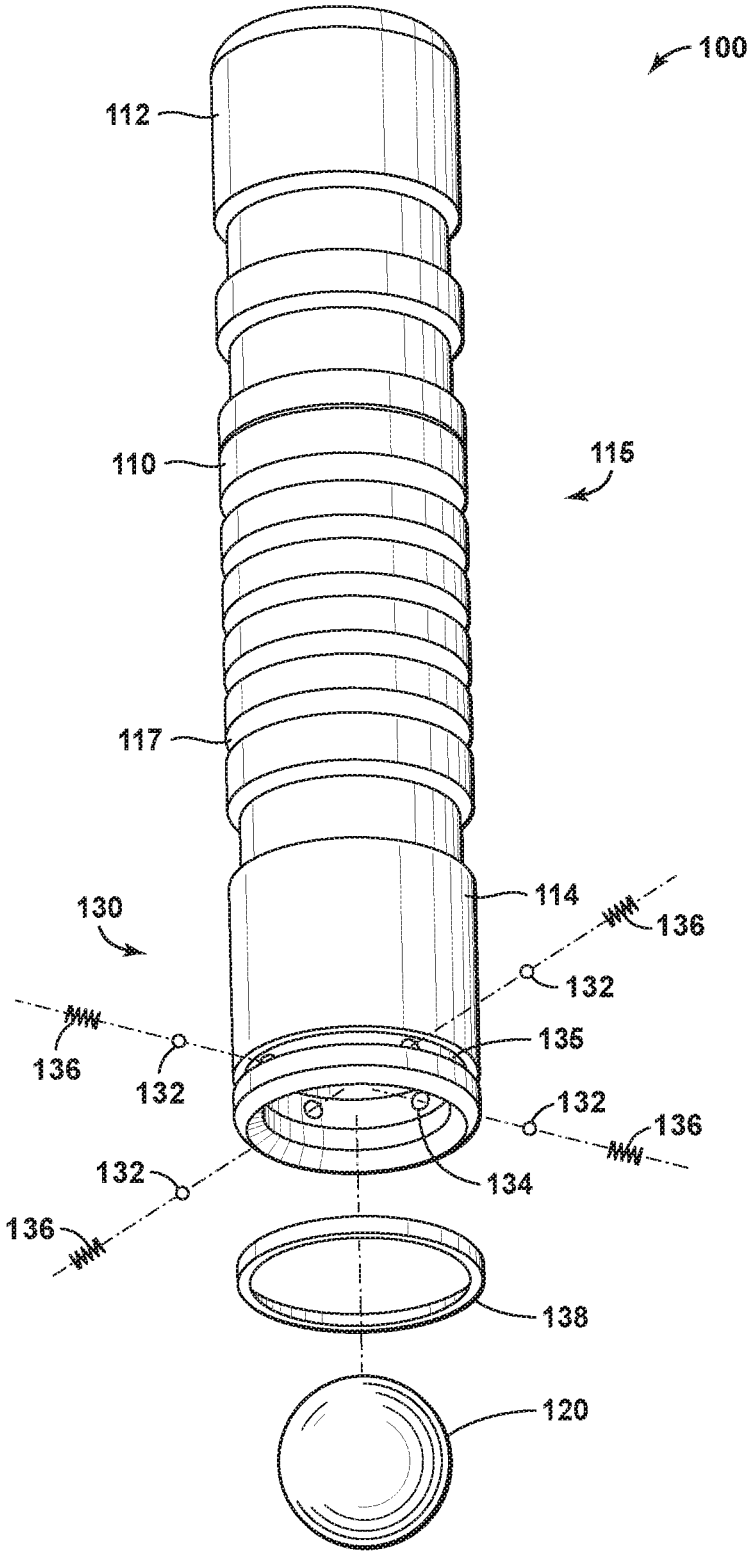
FIG. 1B (Prior Art)
FIG. 1B second perspective view of the continuous plunger of FIG. 1A. Here, components of the plunger are shown in exploded-apart relation, revealing a ball.

Various terms as used in the specification and in the claims are defined below. To the extent a term used in the claims is not defined below, it should be given the broadest reasonable interpretation that persons in the upstream oil and gas industry have given that term as reflected in at least one printed publication or issued patent.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase. A gas may be referred to herein as a "compressible fluid." In contrast, a fluid that is in its liquid phase is an "incompressible fluid."

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface. A hydrocarbon-containing layer may be referred to as a "pay zone."

As used herein, the term "wellbore" refers to a hole in the subsurface made by drilling or insertion of a conduit into the subsurface. A wellbore may have a substantially circular cross section. The term "well," when referring to an opening in the formation, may be used interchangeably with the term "wellbore."

DESCRIPTION OF SELECTED SPECIFIC EMBODIMENTS

Described herein is a plunger lift assembly and methods for using a plunger lift system for the production of hydrocarbons. The plunger lift assembly described herein may be particularly useful in highly deviated wellbores, such as S-curve wells and/or horizontal wells. Horizontal wellbores typically include a first section that is vertical or substantially vertical and then a second section that is relatively long and extends horizontally through a hydrocarbon bearing formation. For example, in some wellbores, the horizontal section extends in excess of 1,000 feet, or 2,000 feet, or 5,000 feet, or more.

Figure 2A:
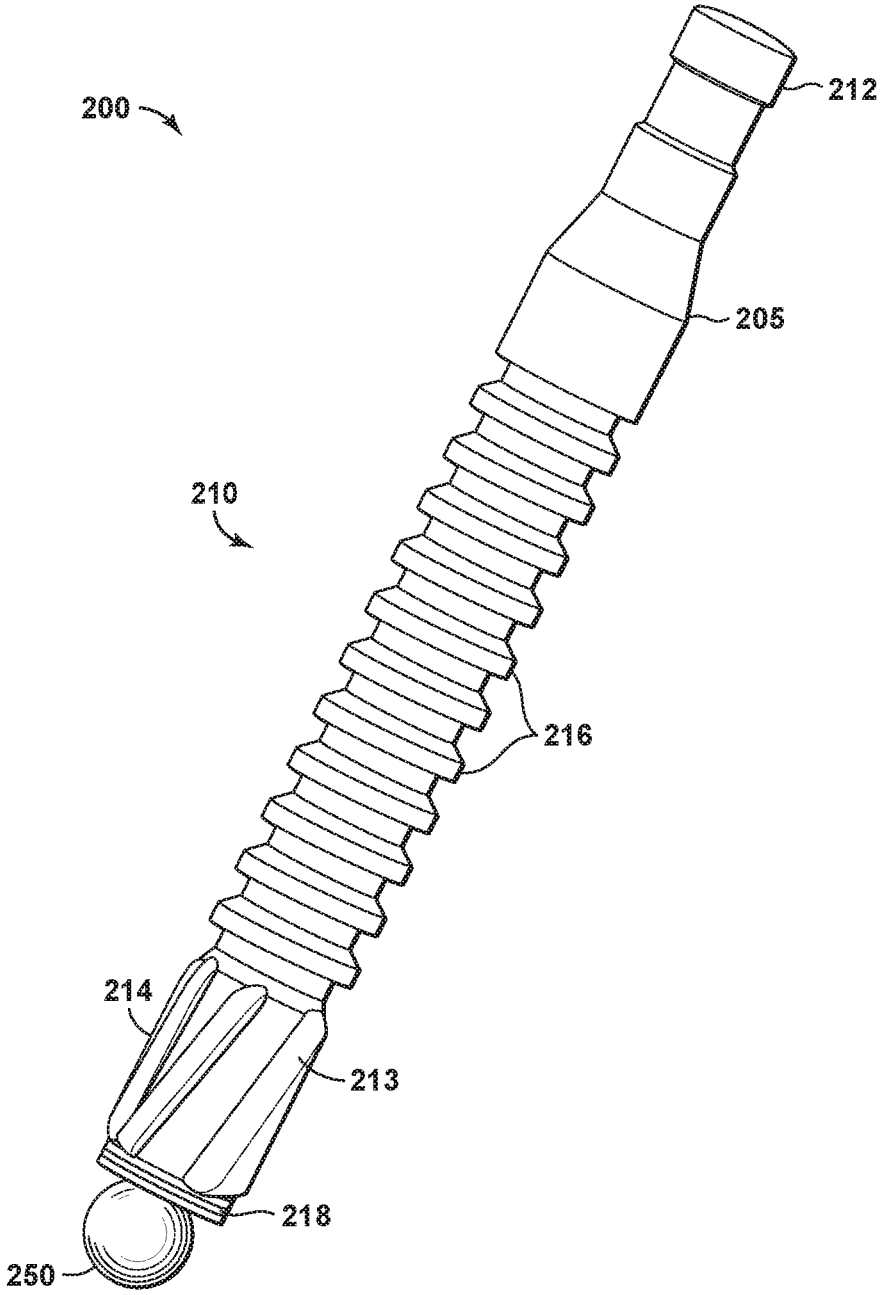
FIG. 2A is a perspective view of a plunger lift assembly of the present invention, in one embodiment.

FIG. 2A is a perspective view of a plunger lift assembly 200 of the present invention, in one embodiment. The plunger lift assembly 200 includes a cylindrical plunger 210, or sleeve, and a sphere 250. In the view of FIG. 2A, the sphere 250, or ball, is just below and is about to land on a seat 218 of the plunger 210.

The plunger 210 defines an elongated cylindrical body 205. The cylindrical body 205 has an upper end 212 and an opposing lower end 214. A series of grooves 216 is optionally provided along the body 205. An inner bore 215 extends within the body 205 from the upper 212 to the lower end 214, forming a fluid flow path.

Figure 4A:
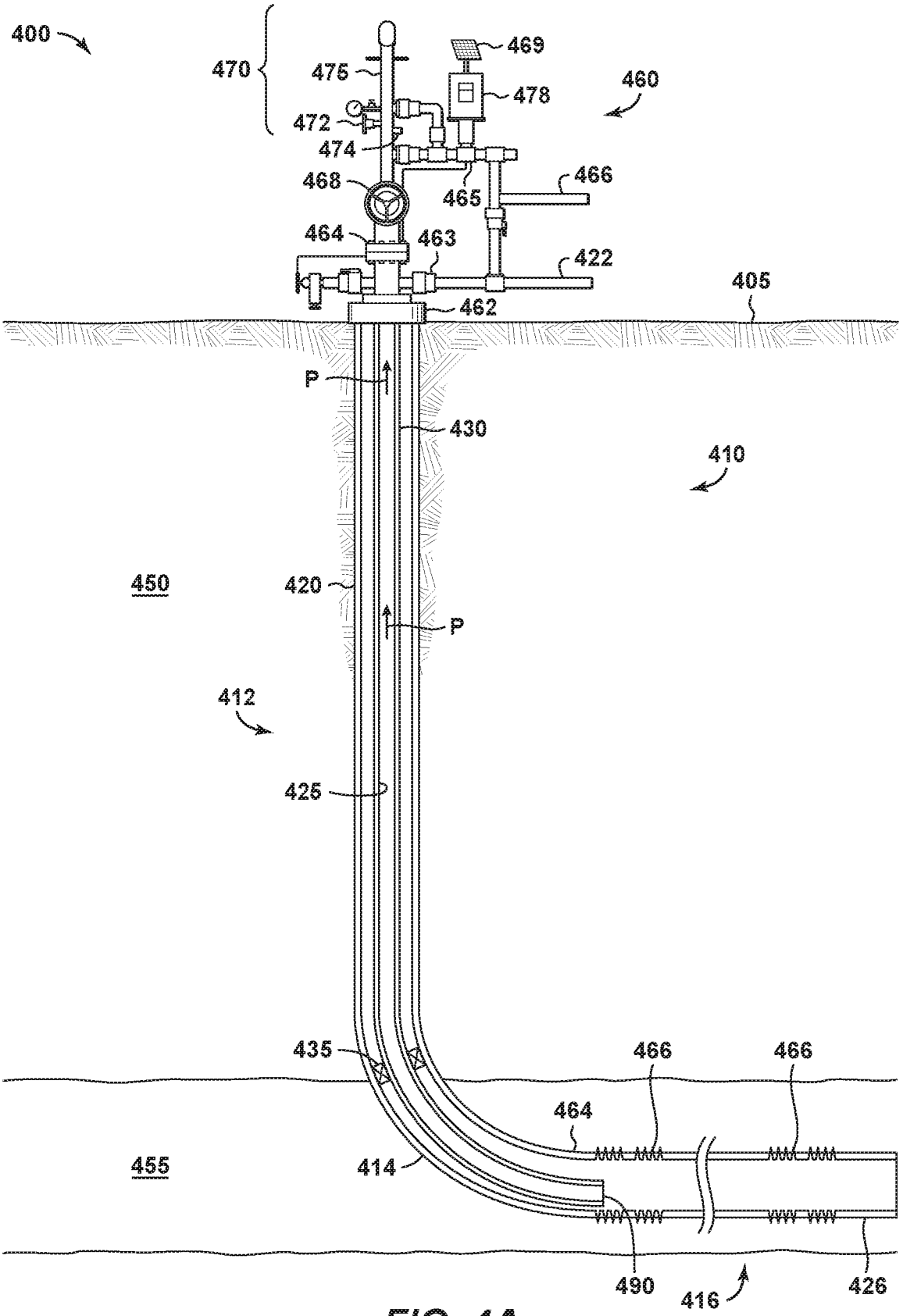
FIGS. 4A through 4E present a series of steps that may be taken to conduct plunger lift operations in the present invention, according to one embodiment.

The longitudinal length of the cylindrical body 205 may be any suitable length for residing along a lubricator (shown at 470 in FIG. 4A as part of a well head 460). In one aspect, the cylindrical body 205 is about 6" in length.

Figure 2B:
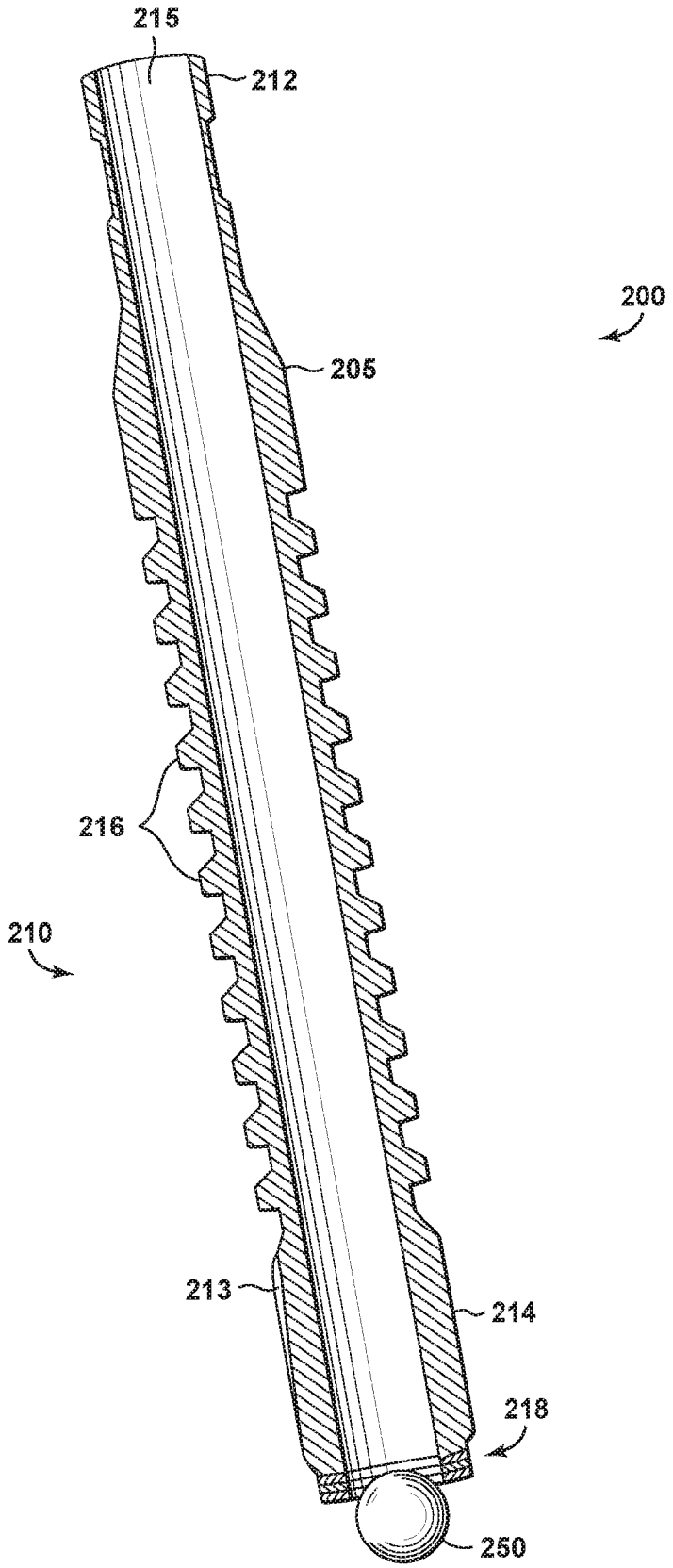
FIG. 2B is a cross-sectional view of the cylindrical plunger, or sleeve, of FIG. 2A. A sealing ball is shown in both FIGS. 2A and 2B.

FIG. 2B is a cross-sectional view of the cylindrical plunger 210 of FIG. 2A. Here, the inner bore is shown at 215.

The cylindrical plunger 210 is preferably fitted with a seat 218. The seat 218 resides at the lower end 214 of the body 205. The seat 218 may be a short cylindrical body having an inner diameter. The inner diameter of the seat 218 has its own bore that is aligned with the bore 215 of the body 205.

Figure 2C:
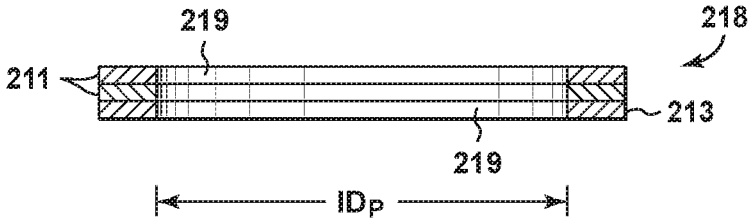
FIG. 2C is a side view of a seat as may reside at a lower end of the sleeve of FIGS. 2A and 2B.

FIG. 2C is a side view of the seat 218 of FIGS. 2A and 2B. An inner bore 219 is shown, forming an inner diameter. Here, the inner diameter is denoted as $ID_P$. It is understood that bore 219 is aligned with bore 215 to form a part of the fluid flow path.

In the illustrative arrangement of FIGS. 2B and 2C, the seat 218 comprises three layers. The top two layers represent elastomeric rings 211. These may be adhesively connected or heat melded to one another. The third layer is a thin, threaded retaining ring 213. The retaining ring 213 may be fabricated from a soft metal or, alternatively, a hardened plastic. It is understood that the composition and design of the seat 218 is a matter of engineer's choice so long as $ID_P$ is dimensioned to sealingly receive the sphere 250.

Figure 3:
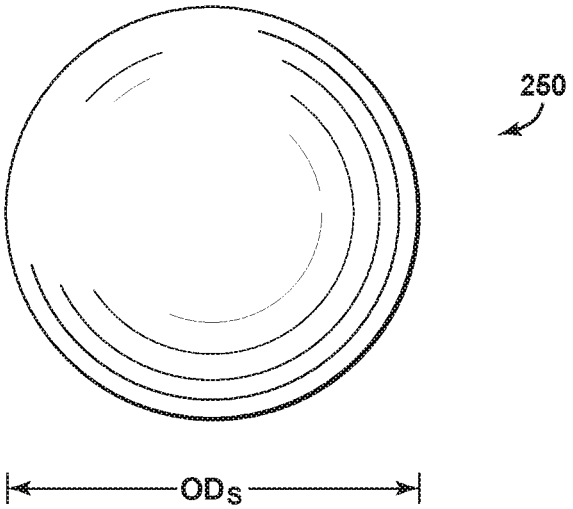
FIG. 3 is a perspective view of a sphere also serving as part of the plunger lift assembly of the present invention.

FIG. 3 is a perspective view of the sphere 250 of FIG. 2A. As noted, the sphere 250 serves as part of the plunger lift assembly 200. The sphere 250 has its own diameter, denoted as $OD_S$. $OD_S$ is greater than $ID_P$, allowing the sphere 250 to land on the seat 218, forming a fluid seal. At the same time, the sphere 250 will freely drop from the seat 218 when the gas pressure is removed.

In one aspect, the seat has a diameter ($ID_P$) of about 1.85" to 1.90". At the same time, the sphere 250 has a diameter ($OD_S$) that is about 1.91" to 1.95". It is understood that the relative presentation of the sphere 250 to the seat 218 in FIGS. 2A and 2B and in FIGS. 2C and 3 are illustrative only and may not be to scale.

Figure 3A:
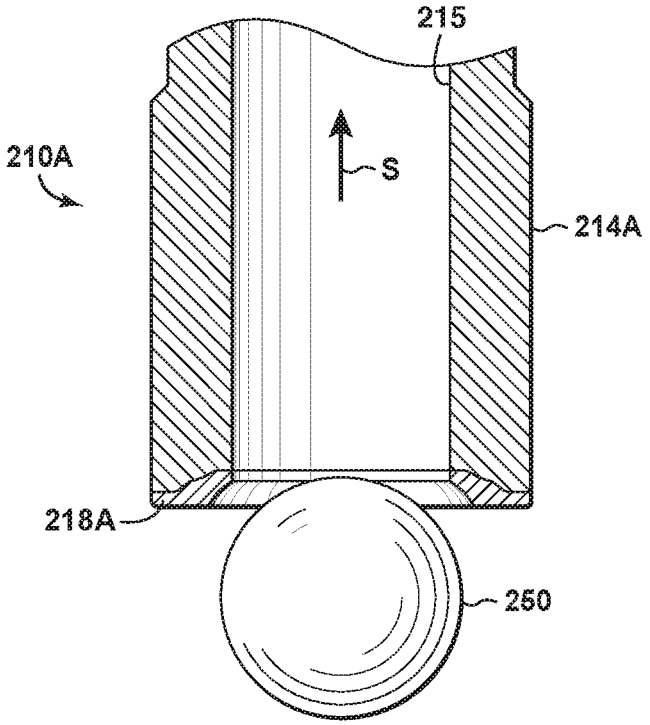
FIG. 3A is a side, cross-sectional view of a lower end of the cylindrical plunger of FIG. 2A, in an alternate embodiment. In this arrangement, a seat resides at a lower tip of the sleeve, ready to receive a sphere.

FIG. 3A is a side, cross-sectional view of a lower end 214A of a cylindrical plunger 210A, in an alternate embodiment. In this arrangement, a seat 218A resides at a lower tip of the plunger 210. The seat 218A preferably comprises a soft metal that is welded or adhesively secured to the lower end 214 of the plunger 210.

Figure 3B:
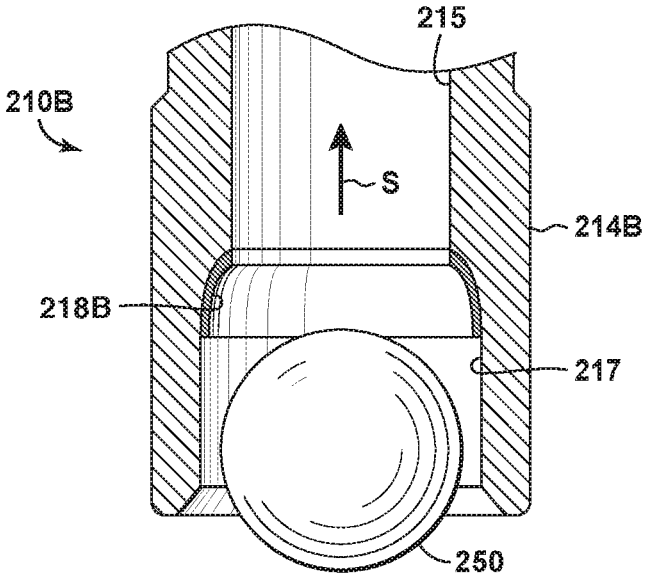
FIG. 3B is another side, cross-sectional view of a lower end of a sleeve as may be used in the plunger lift assembly of the present invention in still another arrangement. Here, a seat is again configured to receive a sphere.

FIG. 3B is another side, cross-sectional view of a lower end 214B of a cylindrical plunger 210B, in another alternate embodiment. Here, a seat 218B is again shown at the lower end 214. In this arrangement, the lower end 214 comprises an enlarged inner diameter section 217, wherein the seat 218B is frictionally or adhesively secured. Thus, in the embodiment of FIG. 3B the seat 218B resides within the bore 215 of the plunger 210. The seat 218B is preferably an elastomeric material designed to sealingly receive the sphere 250.

Arrow "S" is provided in each of FIGS. 3A and 3B, indicating an upward movement of the sphere 250 to accomplish the fluid seal. Upward movement of the sphere 250 is induced by fluid (primarily gas) pressure within a wellbore from below the sphere 250.

The sphere 250 itself is preferably fabricated from steel, although stainless steel, tungsten or carbide may also be considered. In one aspect, the sphere 250 includes a rubber coating. In one arrangement, the sphere 250 may have one or more port holes drilled therein. The holes act to kick up sand in the production tubing as it falls, which may then be lifted during a plunger lift operation. U.S. Patent Publ. No. 2015/0322753 discloses an example of a ball plunger with port holes.

In another arrangement, the sphere 250 may have a plurality of grooves or spirals on the outer surface. The grooves or spirals may act to increase the rotation of the device and decrease the amount of friction on the device as it rolls across the heel of a wellbore. U.S. Patent Publ. No. 2015/0322753 also discloses a ball plunger having grooves or spirals, similar to a tennis ball. This publication is incorporated herein in its entirety by reference.

The plunger body 205 may also be fabricated from steel (including stainless steel), or may alternatively be fabricated from a material having a lower density than steel, such ceramic. The plunger body 205 may alternatively be fabricated from titanium, zirconium, cobalt or other alloys. In one aspect, the plunger body 205 comprises sections made up of a first material and another section made up of a second material. An example of a plunger having a polymeric section is described in U.S. Patent Publ. No. 2018/0003013.

FIGS. 4A through 4E present a series of steps that may be taken to conduct plunger lift operations in the present invention, according to one embodiment. The plunger lift operations are conducted using the plunger lift assembly 200, in its various embodiments.

FIG. 4A is a side, cross-sectional view of a well site 400. The well site 400 comprises a wellbore 410 extending down into a subsurface 450. The well site 400 also includes a wellhead 460 residing at a surface 405 over the wellbore 410.

The wellbore 410 is completed for the purpose of producing hydrocarbon fluids in commercially viable quantities. The wellbore 410 extends down to a reservoir, or "pay zone," 455. In one aspect, the wellbore 410 produces primarily gas, with diminishing liquid production and diminishing reservoir pressure. In one aspect, produced fluids may have a GOR in excess of 500 or, more preferably, above 3,000.

The wellbore 410 is completed with at least one string of casing 420. The wellbore 410 also includes a string of production casing 426. The production casing 426 has been perforated, with perforations 466 shown spaced apart along the pay zone 455. It is understood that the wellbore 410 will likely include multiple strings of casing, including a string of surface casing and one or more intermediate casing strings (not shown).

The wellbore 410 comprises a vertical section 412. The wellbore 410 is completed as a deviated wellbore so that it also has a heel 414 and a deviated section 416. In the illustrative arrangement of FIG. 4A, the deviated section 416 is horizontal. Those of ordinary skill in the art will understand that horizontally-completed wells may extend one, two, or even more miles, and will have multiple stages of perforations 466. In addition, the formation along the pay zone 455 is typically fractured through each of the sets of perforations 466 using various perf-and-frac techniques.

The wellbore 410 also includes a string of production tubing 430. The production tubing 430 defines a bore 425 through which reservoir fluids will travel from the pay zone 455 to the surface 405. Optionally, a packer 435 resides at a lower end of the vertical portion 412 of the wellbore 410. This ensures that production fluids will flow from the production casing 426 up the production tubing 430. Arrows "P" indicate a flow of production fluids up the wellbore 410 and to the wellhead 460.

The wellhead 460 includes a casing head 462 and a tubing head 464. A sales line 466 for gas is provided from the wellhead 460. A master valve 468 is placed above the tubing head 464 as a way of shutting in the wellbore 410. An optional solar panel 469 is provided for local power. An optional production line 422 is shown for receiving produced liquids from the wellhead 460 and transmitting them downstream for fluid processing.

Above the master valve 468 is a lubricator 470. The lubricator 470 is provided as part of a plunger lift system. The lubricator 470 includes a pipe 475, which defines a high pressure conduit configured to releasably hold a plunger lift assembly, such as the assembly 200 described above.

The illustrative lubricator 470 includes a plunger catcher 472. The plunger catcher 472 is designed to receive a metal cylinder, or "plunger" (such as cylindrical plunger 210) when the plunger 210 is forced up to the surface 405. The plunger 210 moves up in response to reservoir pressure when the well is flowing. The plunger 210 is then held at the plunger catcher 472 until such a time as the well is shut in and the plunger 210 is released.

The wellhead 460 may include a motor valve 465 and a controller 478 that assist in controlling the cycle for dropping the plunger 410. Preferably, the plunger 410 is simply dropped once the well is shut in. In this respect, the controller 478 sends signals to periodically open and close a production valve 463 or master valve 468. The lubricator 470 may include one or more sensors, for example, a sensor 474 to detect the presence of the plunger 210 within the lubricator 470.

It is understood that the lubricator 470 shown in FIG. 4A is merely illustrative. Any lubricator arrangement may be used. The term "lubricator" as used herein is meant to include any high pressure conduit in fluid communication with the wellhead and arranged to receive a plunger or "sleeve." The lubricator may or may not include a motor valve 465 or a catcher 472.

In the present disclosure, the lubricator 470 is used to releasably hold the plunger lift assembly 200. The cylindrical plunger 210 and the sphere 250 are held together in the catcher 472, and released from the wellhead 460 simultaneously when the valve 463 is closed, shutting in the well 400. The sphere 250 is dropped ahead of the cylindrical plunger 210.

Figure 4B:
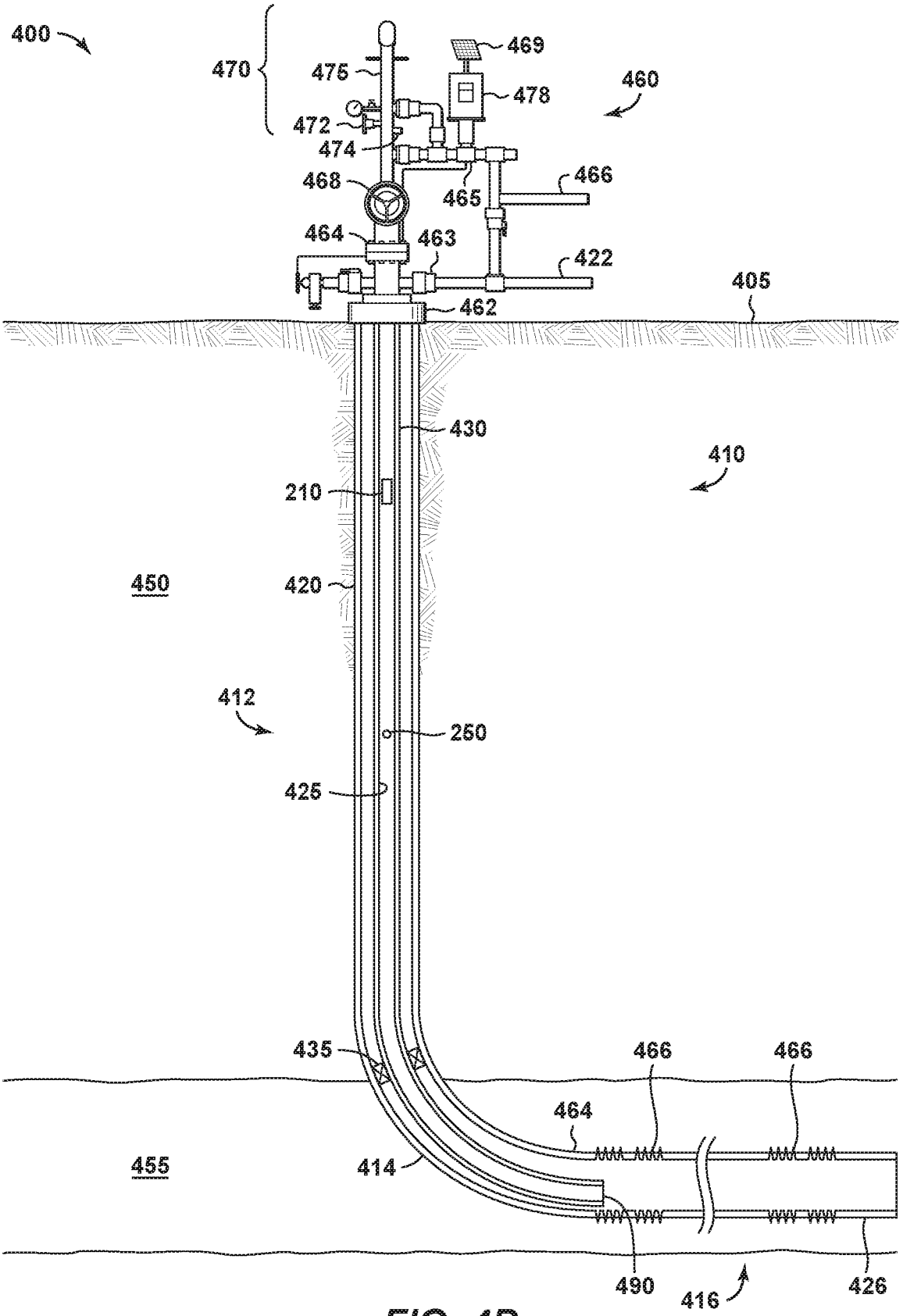

FIG. 4B shows the plunger lift assembly 200 having been released into the string of production tubing 430. It can be seen that the sphere 250 and cylindrical plunger 210 are gravitationally falling along the vertical section 412 of the wellbore 410. The sphere 250 will fall to the heel 414 of the wellbore 410 and typically fall to at least a point that is 70° from vertical. More likely, the sphere 250 will roll into the deviated section 416 where it will ultimately land close to the end of the production tubing 430.

An energy absorption element may be placed at the end of the tubing string 430. The absorption element may be a bumper spring (not shown). More preferably, the absorption element is an end sub 490. Because the ball 250 is rolling through fluid along an extended deviated section 416, the ball 250 should be rolling rather slowly by the time it gets to the end of the tubing 430 and no spring is needed.

The end sub will include perforations that permit produced fluids to flow into the production tubing 430 from the casing 426. In this way, produced liquids and gases will bypass the sphere 250 into the production tubing 430.

Figure 4C:
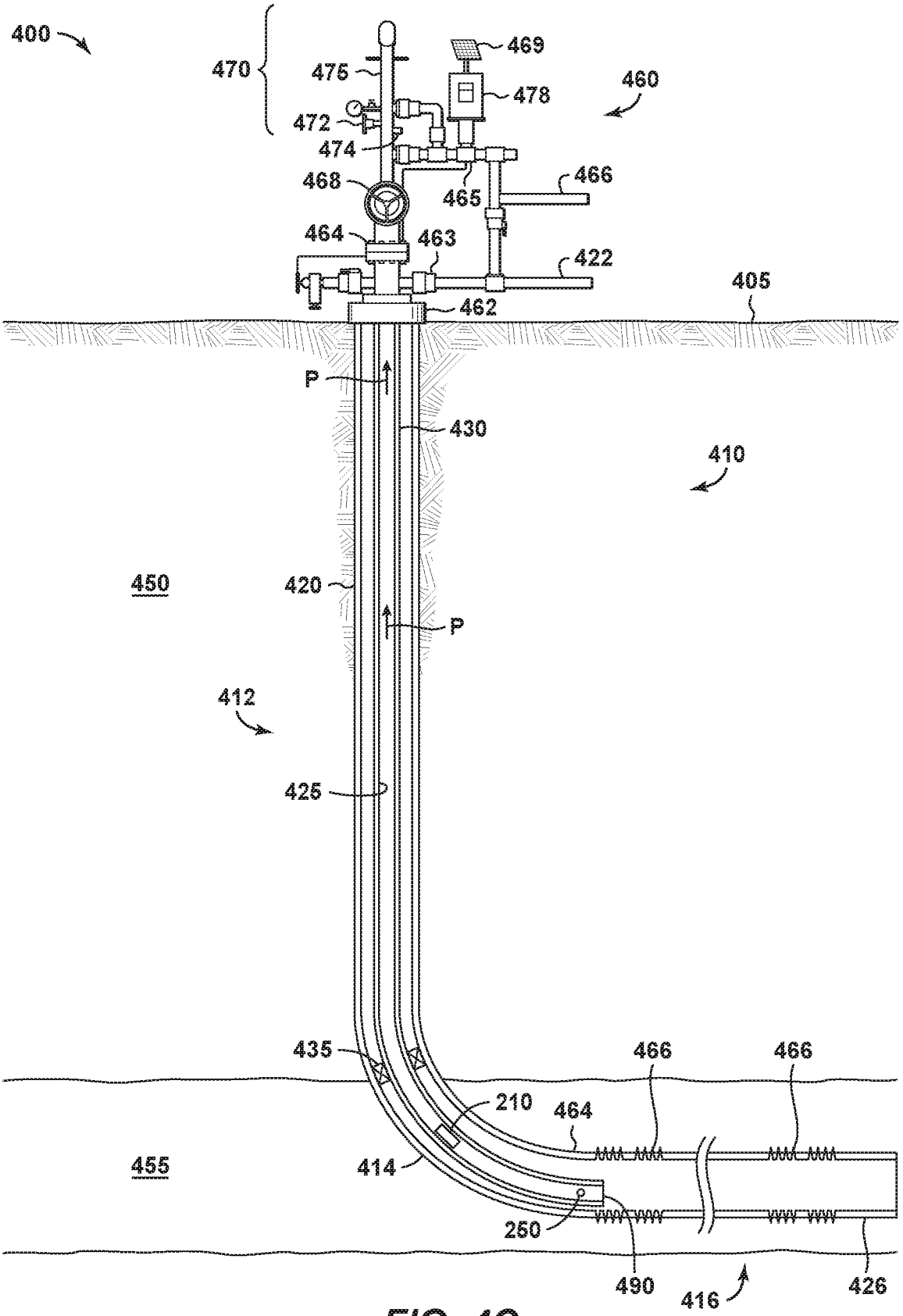

FIG. 4C shows that the sphere 250 of the plunger lift assembly 200 has traveled along the production tubing 430 and down to the perf sub 490. At the same time, the cylindrical plunger 210 has stopped along the heel 414 of the horizontal wellbore. Typically, the plunger 210 will stop at a position that is at least 45° from vertical, and sometimes about 70° from vertical.

Figure 4D:
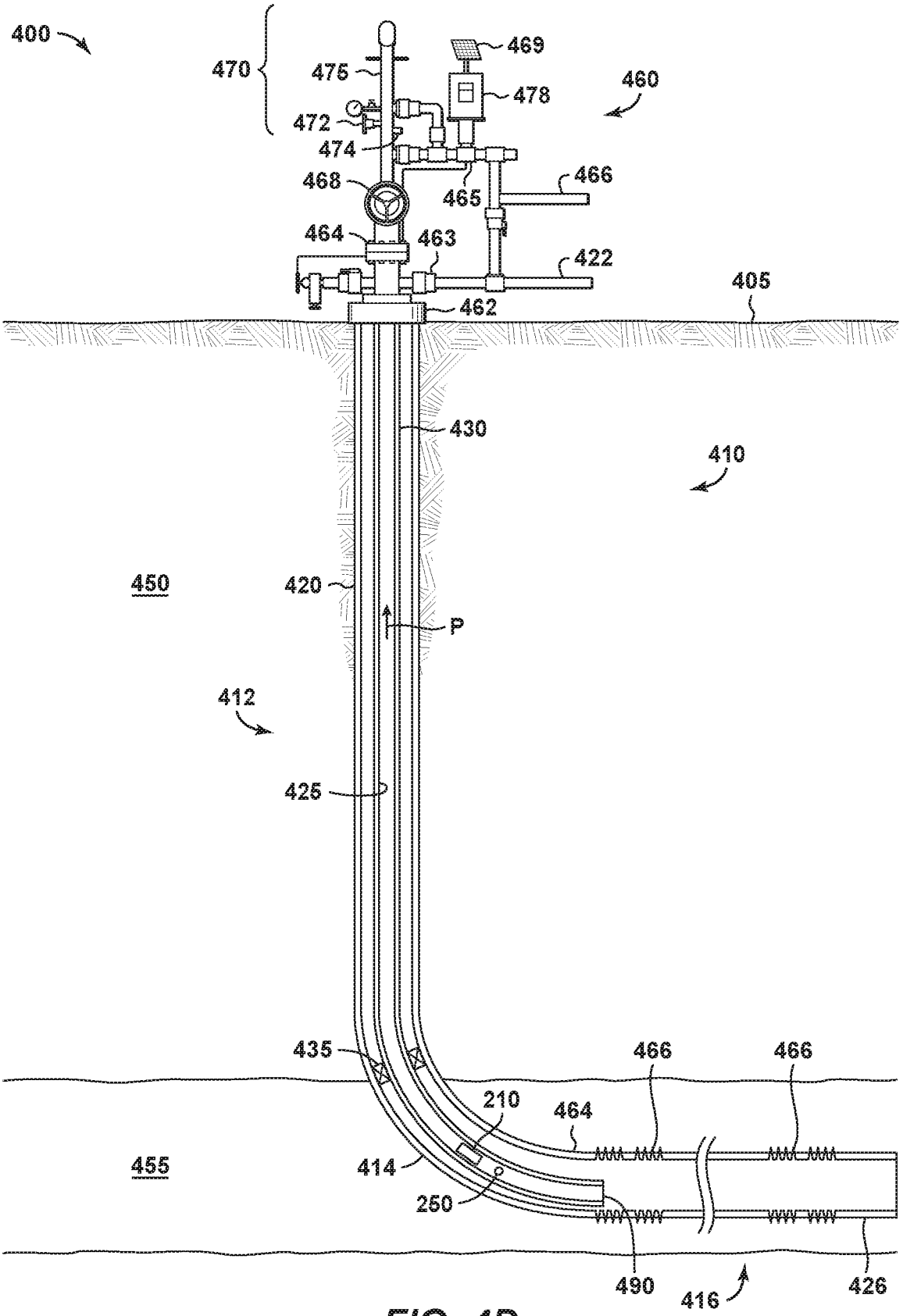

FIG. 4D shows that pressure has built in the production tubing 430. This is a result of the well 400 having been shut in for a period of time. Formation gases will enter the production casing 426 and cause the sphere 250 to be raised back up the production tubing 430. Accumulated liquids in the wellbore 410 (not shown) are forced up the tubing 430 ahead of the sphere 250. This is because the diameter ($OD_S$) of the sphere 250 is only slightly less than the diameter ($ID_T$) of the production tubing 430.

Preferably, $OD_S = ID_{T-x}$; where $x \leq 0.02$ inches (0.051 cm). Alternatively, x may be less than 0.03 inches.

Note that as the sphere 250 rises, the liquids will pass through the bore 215 plunger 210 until the sphere 250 meets the plunger 210. At the same time, the sphere 250 acts as a wellbore sealing device once it is seated onto the bottom 214 of the plunger 210.

Figure 4E:
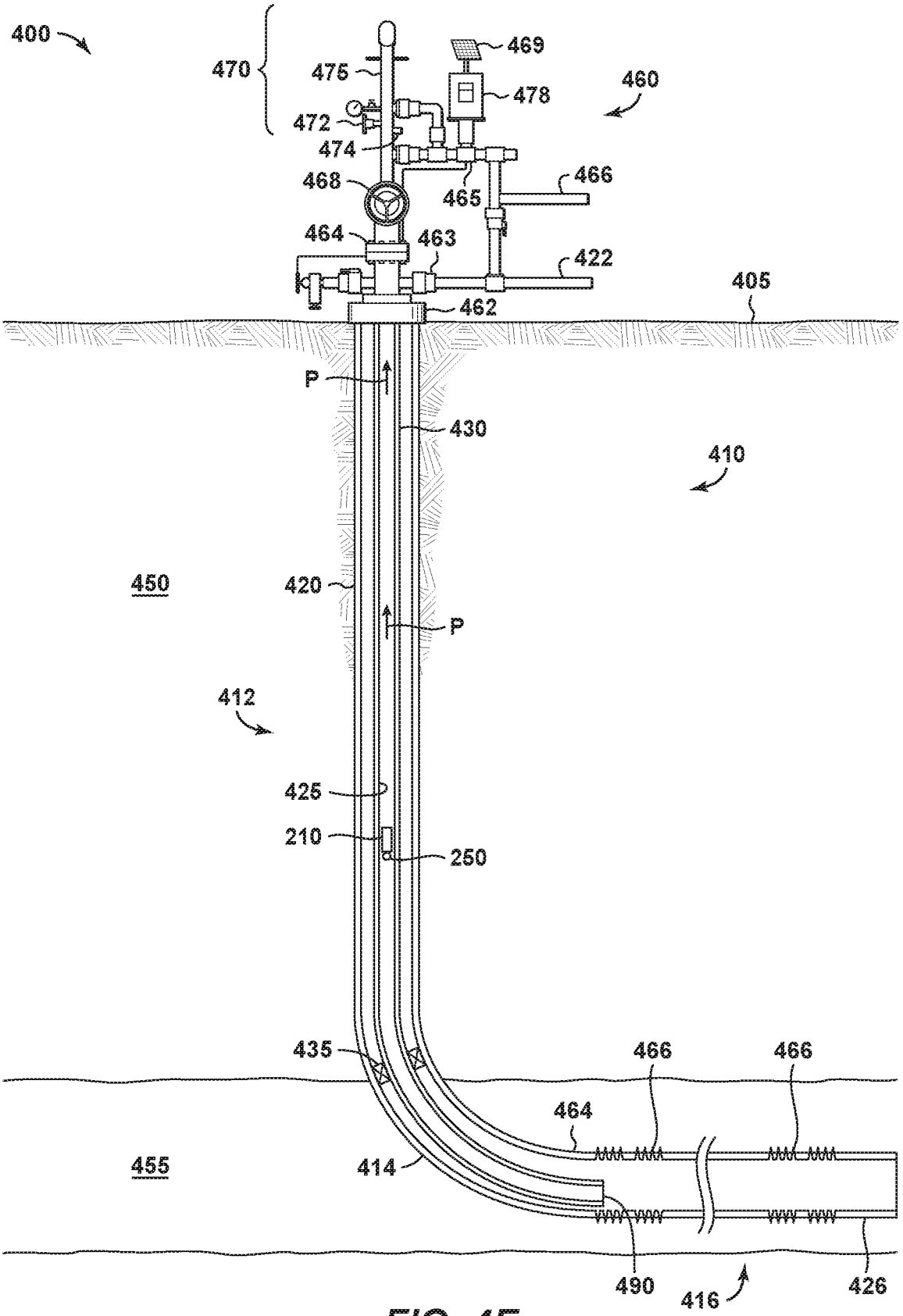

FIG. 4E shows that the sphere 250 has landed on the bottom 214 of the cylindrical plunger 210. Upward pressure from formation gases creates a fluid seal between the sphere 250 and the plunger 210. The same formation gases push the sphere 250 and plunger up the vertical section 412 of the wellbore 410, together. Liquids that have accumulated in the production tubing 430 above the plunger 210 are lifted ahead of the plunger 210.

Figure 5:
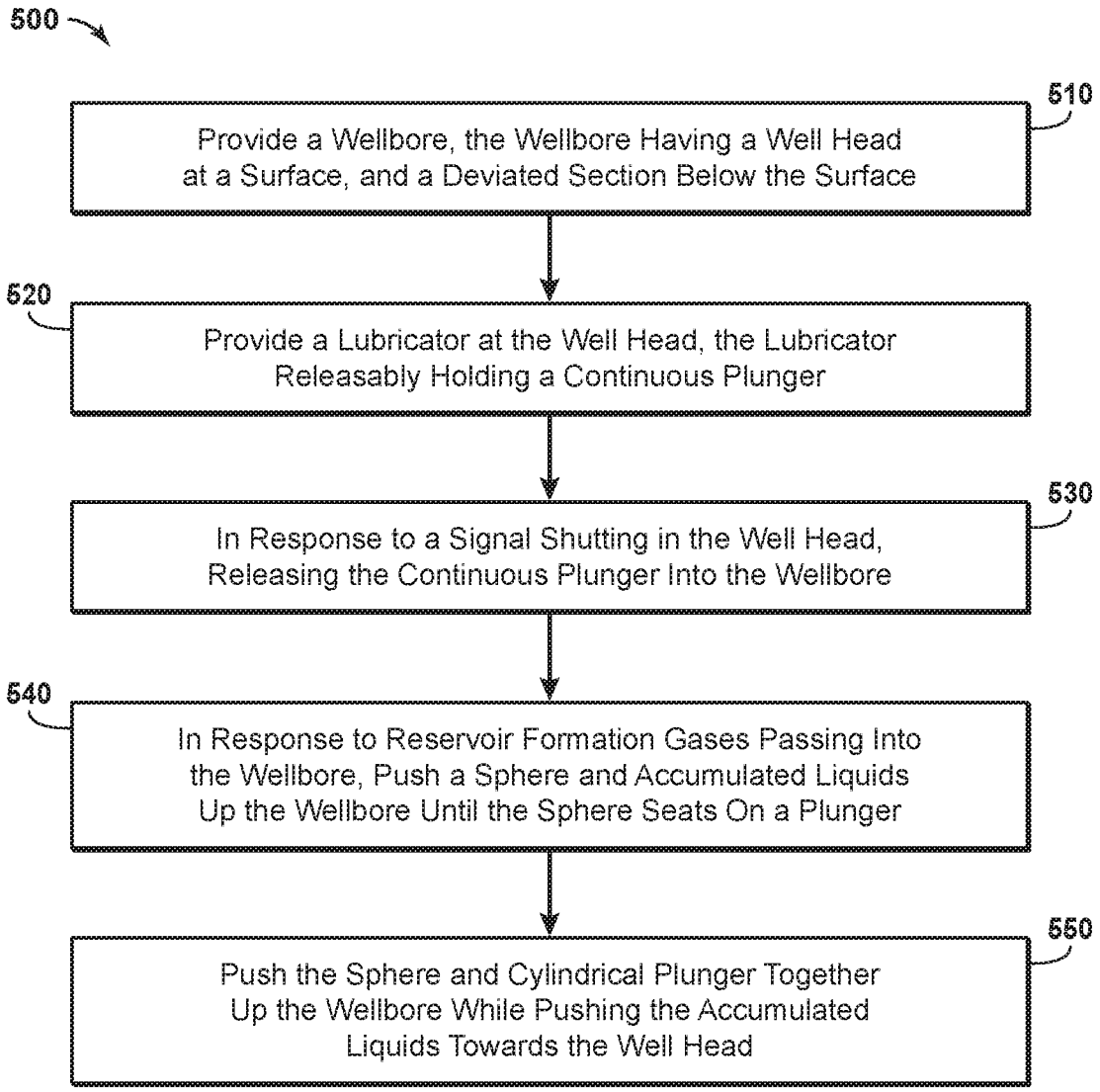
FIG. 5 is a flow chart showing steps for a method of lifting liquids from a formation using a plunger lift assembly, in one embodiment.

Based on the plunger lift assembly 200 shown in FIGS. 2A-2C and FIGS. 3, 3A and 3C, along with the wellbore diagrams of FIGS. 4A-4E, a method of lifting liquids from a formation using a plunger lift assembly is provided herein. FIG. 5 is a flow chart showing steps for a method 500 of lifting liquids from a formation using a plunger lift assembly, in one embodiment.

The method 500 first comprises providing a wellbore. This is shown in Box 510. The wellbore includes a wellhead at a surface. At least one string of casing extends down from the wellhead. In addition, the wellbore includes a string of production tubing. Of interest, the production tubing has an inner diameter ($ID_T$).

The wellbore has been formed for the purpose of producing hydrocarbon fluids to the surface. Typically, the well will produce primarily hydrocarbon fluids that are compressible at surface conditions, e.g., methane and ethane, but there will likely also be at least some hydrocarbon liquids, albeit in diminishing quantities. So-called impurities such as hydrogen sulfide and oxygen may also be present which will need to be separated out after production to meet pipeline specifications.

In the step of Box 510, the wellbore comprises a vertical section, a deviated section, and a heel. The heel provides for a curved transition from the vertical section to the deviated section. Preferably, the deviated section is substantially horizontal although it may also have an S-shaped portion. In any instance, the production tubing typically extends down to at least a top of the heel, and in some cases into the deviated section.

The method 500 additionally includes providing a lubricator at the wellhead. This is indicated at Box 520. The lubricator is configured to releasably hold a cylindrical plunger and a flow restriction member. Preferably, the flow restriction member is a sphere. Together, the plunger and the sphere form a plunger lift assembly.

The plunger and the sphere are held in place in the lubricator by wellbore pressure when the well is flowing. In contrast to known systems, the sphere does not releasably reside within the plunger while the assembly is in the lubricator. In other words, the sphere is free to fall in the absence of wellbore pressure from below.

Of interest, the cylindrical plunger has an inner diameter ($ID_P$). More specifically, a seat at the lower end of the cylindrical plunger forms the inner diameter ($ID_P$). At the same time, the sphere has an outer diameter $OD_S$. $ID_T$ is greater than $OD_S$, while $OD_S$ is greater than $ID_P$.

A controller may be provided with the wellhead. The controller is configured to send signals, either in periodic time increments that are pre-set or in response to pressure signals from the wellbore. The signals open and close a production valve at the wellhead. When the valve is open, the well is flowing; when the valve is closed; the well is shut in.

In connection with the steps of Boxes 510 and 520, it is understood that the term "providing" includes having access to, or using. Thus, the phrase "providing a wellbore" includes a service company accessing an existing wellhead. Similarly, the phrase "providing a lubricator" includes a service company installing a lubricator or modifying a wellhead to have a lubricator at a well site, or accessing an existing lubricator.

In response to a signal from a timer or from the controller shutting in the wellhead, the method 500 further includes releasing the cylindrical plunger and the sphere into the wellbore. Specifically, the cylindrical plunger and the sphere fall into the production tubing, simultaneously. This is seen at Box 530. This allows the plunger and the sphere to gravitationally fall into the wellbore and down to at least the heel.

In one embodiment, the cylindrical plunger gravitationally falls in the wellbore to a position along the heel of the wellbore that is at least 45° from vertical. More typically, the cylindrical plunger falls in the wellbore to a position along the heel of the wellbore that is about 65° to 70° from vertical. At the same time, the sphere gravitationally falls into the wellbore ahead of the plunger to a position along the heel of the wellbore that is at least 75° from vertical. More preferably, the sphere gravitationally falls into the wellbore ahead of the plunger and down below a liquid level within the wellbore. More preferably still, the sphere rolls all the way across the heel into the horizontal (or otherwise deviated) section of the wellbore.

In one aspect, the wellbore comprises a bumper assembly along the deviated section. Upon being released from the lubricator and upon gravitationally falling into the production tubing, the sphere lands onto the bumper assembly. The bumper assembly preferably includes a spring placed along the production tubing along a horizontal section of the wellbore. More preferably, the sphere lands on a perf sub provided at the end of the production tubing extending into the deviated section of the well without absorbing force.

In response to reservoir formation gases passing into the wellbore, the method 500 additionally includes pushing the sphere up the wellbore. The sphere travels until it seats on a lower end of the cylindrical plunger. This is shown in Box 540. During this step of Box 540, the sphere pushes accumulated liquids ahead of it. The accumulated liquids will pass through the seat ($ID_P$) and an inner bore of the cylindrical plunger.

The method 500 then includes further pushing the sphere and the cylindrical plunger up the production tubing and to the lubricator. This is provided in Box 550. Note that the sphere has landed on the cylindrical plunger, forming a substantial fluid seal. As the plunger and sphere move up the wellbore, wellbore liquids are pushed upwardly above the seal and towards the wellhead. The plunger and sphere ultimately move back into the lubricator and stay until the well is again shut in.

Figure 6A:
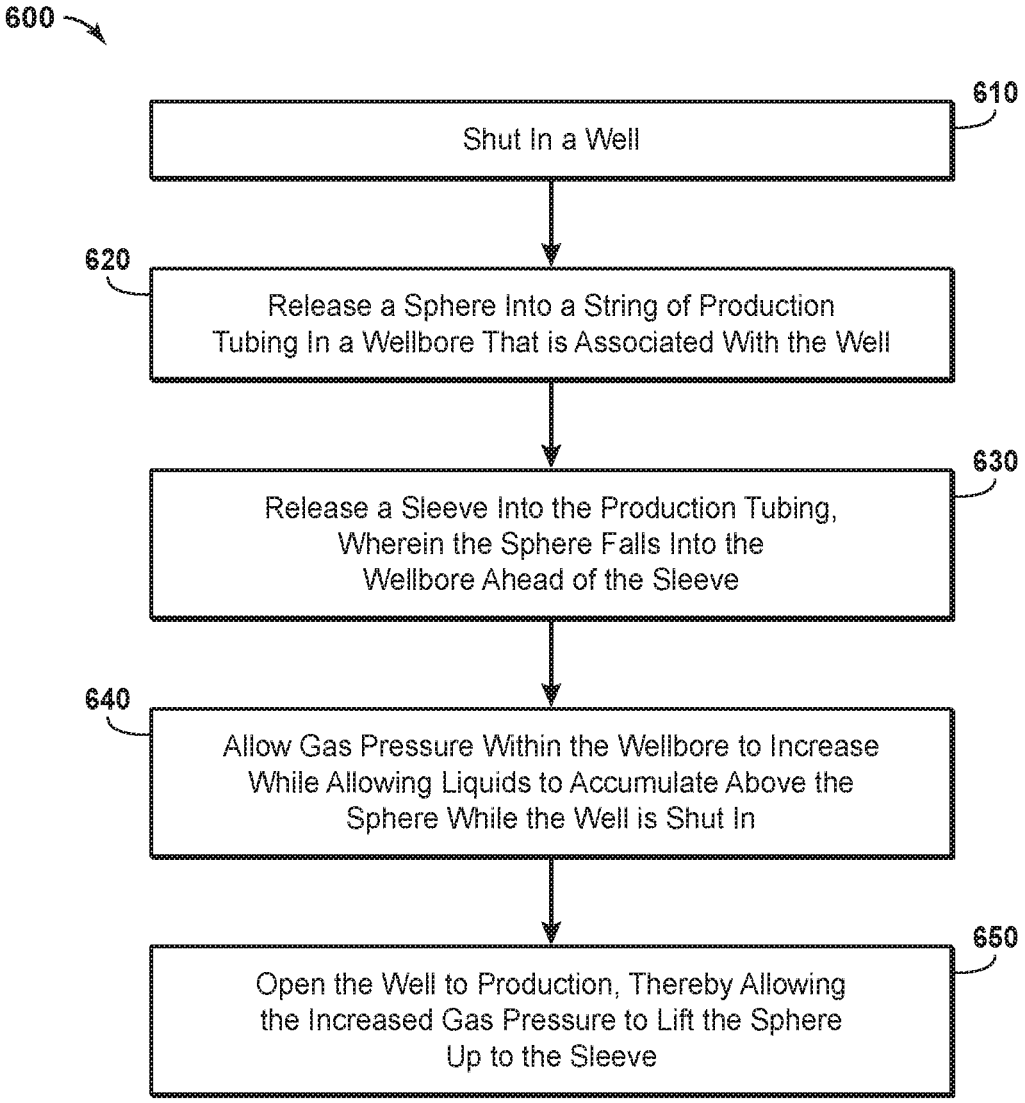
FIGS. 6A and 6B together show a flow chart representing steps for a method of lifting liquids from a formation using a plunger lift assembly, in an alternate embodiment.
Figure 6B:
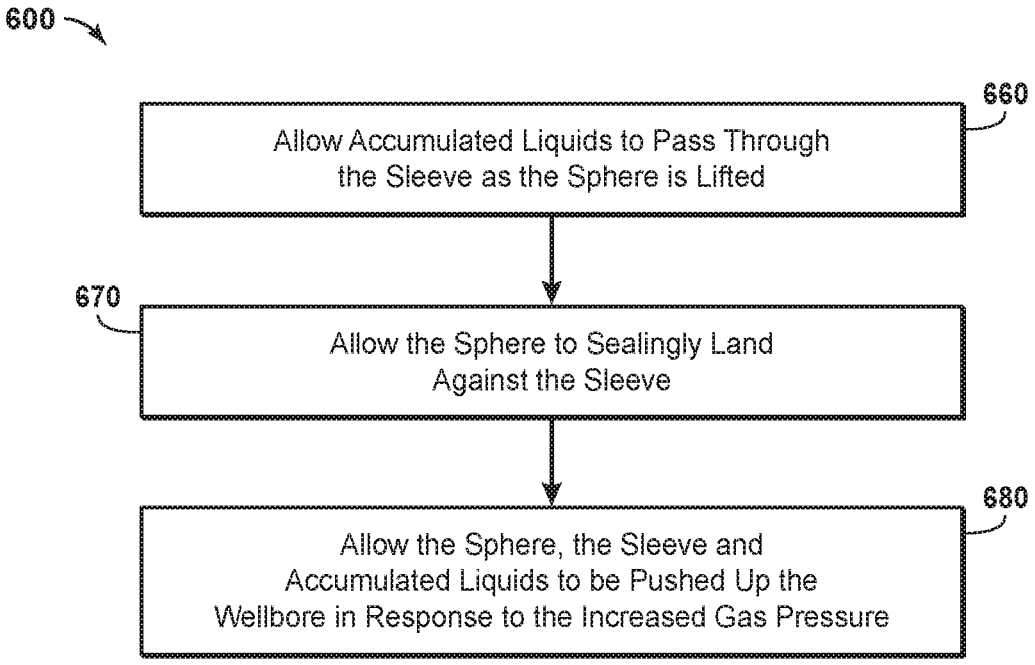

A method of providing artificial lift during hydrocarbon production operations at a well is also provided herein. FIGS. 6A and 6B together demonstrate a method 600 for conducting the artificial lift operations, in one embodiment.

The method first comprises shutting in a well. This is shown at Box 610. The well may be, for example, well 400 in FIGS. 4A through 4F. The well will include a wellhead at a surface and a wellbore extending down below the surface to a subsurface formation.

In one aspect, the wellbore comprises a vertical section, a deviated section, and a heel. The heel provides for a curved transition from the vertical section to the deviated section. Preferably, the deviated section is at 75° or more from vertical. More preferably, the deviated section is horizontal.

The wellbore has been formed for the purpose of producing hydrocarbon fluids to the surface in commercially viable quantities. Typically, the well will produce primarily hydrocarbon fluids that are compressible at surface conditions, e.g., methane and ethane, but there will likely also be at least some hydrocarbon liquids, albeit in diminishing quantities. However, the well also produces liquids, causing the well to become loaded.

The method 600 also comprises releasing a sphere into a conduit within the wellbore. The conduit is preferably a string of production tubing. This is seen in Box 620. The production tubing has an inner diameter ($ID_T$), which is preferably between 1.85" and 1.95". At the same time, the sphere preferably has a diameter ($OD_S$) that is between 1.75" and 1.91".

In one embodiment, the production tubing is 2⅜", 4/70 lb/ft tubing, with an API drift diameter of 1.901" and an ID of 1.995". In such an example, the sphere will have an $OD_S$ that is between about 1.701" up to about 1.990". Preferably, the sphere has a diameter ($OD_S$) of 1.91". In any instance, $ID_T$ is greater than $OD_S$.

The method 600 additionally includes releasing a sleeve into the conduit, that is, into the production tubing. This is provided in Box 630. The sleeve falls into the production tubing behind the sphere. As described above, the sleeve defines a cylindrical plunger having an inner bore. A seat resides at a lower end of the sleeve. Preferably, the seat has an inner diameter ($ID_P$) that is between 1.88" and 1.91". Note that $ID_P$ is less than $OD_S$.

Preferably, releasing the sphere into the wellbore comprises allowing the sphere to gravitationally fall from a lubricator, into the wellbore and through the production tubing. At the same time, releasing the sleeve into the wellbore comprises allowing the sleeve to gravitationally fall from the lubricator, into the wellbore and through the production tubing immediately behind the sphere.

In one embodiment, the sleeve comes to rest after gravitationally falling into the wellbore at a position within the heel that has a deviation of 75° or less from vertical. At the same time, the sphere comes to rest after gravitationally falling into the wellbore at a position along the deviated section. In other words, the sphere traverses the heel completely.

The method 600 further includes allowing gas pressure within the wellbore to build up. This is offered in Box 640. This occurs while the well remains shut in. During this time, the sphere resides proximate a bottom of the production tubing or otherwise beyond the heel. Production liquids accumulate in the well, above the sphere.

The method 600 next includes opening the well to production. This is indicated at Box 650 of FIG. 6A. Opening the well to production allows the increased gas pressure to lift the sphere up to the sleeve. The sphere travels until it lands on the seat at a lower end of the cylindrical plunger.

The method 600 additionally includes allowing the accumulated liquid to pass through the sleeve. This is shown at Box 660 of FIG. 6B. During this step of Box 660, the sphere pushes accumulated liquids ahead of it. The accumulated liquids will pass through the seat ($ID_P$) and the inner bore of the cylindrical plunger.

The method 600 also provides for allowing the wellbore sealing device to land against the sleeve. This is seen in Box 670. Preferably, the sleeve includes an elastomeric or ductile material at a lower end, forming a seat against which a fluid seal can be formed.

The method 600 further provides for allowing the seat, the sleeve and the accumulated liquids to be pushed up the production tubing in response to the increased gas pressure. This is offered in Box 680.

As can be seen, improved methods for conducting artificial lift for a wellbore using a plunger lift system are provided. Because of the diameter of the sphere ($OD_S$) relative to the diameter of the production tubing ($ID_T$), the sphere is successful in pushing up most if not all of the accumulate fluids in the wellbore. In one aspect, at least 90% of all liquids are advanced up the wellbore ahead of the sphere when the well is opened to flow.

Although the plunger lift assembly and the plunger lift methods provided have been described in the present disclosure with respect to unloading liquids from gas wells that continue to load in the wellbore, the plunger lift assembly and methods may be used in other applications. For example, the plunger lift assembly may be used for by-pass plunger lift; gas-assisted plunger lift; increasing the production of oil producing wellbores when the bottom hole pressure is insufficient to support fluid flow to the surface; minimizing liquid fallback to the bottom of the wellbore and reducing the possibility of gas penetration through a liquid slug; and cleaning the inner diameter of a wellbore conduit having wax or other solids deposited therein.

What is claimed is:

1. A method of lifting liquids from a formation using a plunger lift assembly, comprising:

providing a wellbore having a wellhead at a surface, wherein:

the wellbore comprises a vertical section, a deviated section, and a heel forming a curved transition from the vertical section to the deviated section, and the wellbore further comprises a string of production tubing having an inner diameter ($ID_T$);

providing a lubricator at the wellhead, the lubricator being configured to releasably hold a cylindrical plunger having an inner diameter ($ID_P$), and a sphere having an outer diameter ($OD_S$), wherein:

$ID_T$ is greater than $OD_S$; and $OD_S$ is greater than $ID_P$;

releasing the cylindrical plunger and the sphere into the production tubing simultaneously, thereby allowing the plunger and sphere to gravitationally fall into the wellbore and down to at least the heel, with the sphere falling into the production tubing ahead of the plunger;

in response to reservoir formation gases passing into the wellbore, pushing the sphere and accumulated liquids up the wellbore until the sphere seats on a lower end of the cylindrical plunger; and further pushing the sphere and cylindrical plunger up the production tubing and to the lubricator together, thereby pushing the accumulated liquids upwardly towards the wellhead ahead of the plunger;

wherein an energy absorption element is placed at the end of the string of production tubing; and wherein the plunger falls in the wellbore to a different position than the sphere.

2. The method of claim 1, wherein:

the cylindrical plunger and sphere are released in response to a signal shutting in the wellhead to flow;

the cylindrical plunger gravitationally falls in the wellbore to a position along the heel of the wellbore that is at least 45° from vertical; and the sphere gravitationally falls into the wellbore ahead of the plunger along the heel of the wellbore to a position that is at least 70° from vertical.

3. The method of claim 2, wherein:

the wellbore comprises a bumper assembly along the deviated section; and the sphere lands on the bumper assembly when the sphere gravitationally falls from the lubricator.

4. The method of claim 2, wherein the deviated section defines a horizontal section.

5. The method of claim 2, wherein:

a lower end of the cylindrical plunger comprises a seat;

$ID_P$ is formed by the seat; and the sphere gravitationally falls down below a liquid level within the wellbore.

6. The method of claim 5, wherein:

the sphere is configured to land on the seat in response to gas pressure from below the plunger, forming a fluid seal, but to freely drop from the seat when the gas pressure is removed; and pushing the sphere up the wellbore causes at least 90% of accumulated liquids to be pushed up the wellbore and through $ID_P$ until the sphere lands on the seat.

7. The method of claim 1, wherein:

the cylindrical plunger gravitationally falls in the wellbore to a position along the heel of the wellbore that is at least 65° from vertical;

the sphere gravitationally falls in the wellbore where it passes across the heel and then rolls into the horizontal portion of the wellbore;

a lower end of the cylindrical plunger comprises a seat, with the seat forming $ID_P$; and pushing the sphere up the wellbore causes accumulated liquids to be pushed up the wellbore and through $ID_P$ until the sphere lands on the seat.

8. The method of claim 1, wherein at least 90% of all liquids are advanced up the wellbore ahead of the sphere when the wellbore is opened to flow.

9. The method of claim 1, wherein plunger falls in the wellbore to a position that is at least 45° from vertical and the sphere falls in the wellbore to a position that is at least 70° from vertical.

10. The method of claim 1, wherein plunger falls in the wellbore to a position that is at least 65° from vertical and the sphere falls in the wellbore to a position that is at least 75° from vertical.

11. The method of claim 1, wherein the sphere falls down below a liquid level within the wellbore.

12. A method of providing artificial lift during hydrocarbon production operations at a well, comprising:

shutting in the well;

releasing a wellbore sealing device into a conduit in a wellbore associated with the well;

releasing a sleeve into the conduit in the wellbore, wherein the sleeve has an inner diameter ($ID_P$) that is less than an outer diameter ($OD_S$) of the wellbore sealing device, and wherein the wellbore sealing device falls into the conduit immediately ahead of the sleeve and lands close to the end of the conduit;

allowing gas pressure within the wellbore to increase, and allowing liquids to accumulate above the wellbore sealing device within the wellbore, while the well is shut in;

opening the well, thereby allowing the increased gas pressure to lift the wellbore sealing device and accumulated liquids up to the sleeve;

allowing the accumulated liquids to pass through the sleeve as the wellbore sealing device is lifted;

allowing the wellbore sealing device to land against the sleeve; and allowing the wellbore sealing device, sleeve and accumulated liquids to be pushed up the conduit and to a wellhead in response to the increased gas pressure;

wherein the sleeve falls in the wellbore to a different position than the sphere.

13. The method of claim 12, wherein:

the wellbore comprises a vertical section, a deviated section, and a heel forming a curved transition from the vertical section to the deviated section, with the deviated section bending to 75° or more from vertical;

the conduit in the wellbore is a string of production tubing, wherein the production tubing has an inner diameter $ID_T$, with $ID_T$ being greater than $OD_S$;

the wellbore sealing device is a sphere;

releasing the wellbore sealing device into the wellbore comprises allowing the sphere to gravitationally fall from a lubricator, into the wellbore and through the production tubing;

releasing the sleeve into the wellbore comprises allowing the sleeve to gravitationally fall from the lubricator, into the wellbore and through the production tubing immediately behind the sphere.

14. The method of claim 13, wherein:

$OD_S = ID_{T-x}$; and $x \leq 0.02$ inches (0.051 cm).

15. The method of claim 14, wherein:

the sleeve comes to rest after gravitationally falling into the wellbore at a position within the heel; and the sphere rolls across the heel after gravitationally falling into the wellbore.

16. The method of claim 14, wherein:

the deviated section is horizontal;

the sphere comes to rest after gravitationally falling into the wellbore at a position along the horizontal deviated section; and the sphere is configured to land on the seat in response to the increased gas pressure from below the plunger, forming a fluid seal, but to freely drop from the seat when the gas pressure is removed.

17. The method of claim 13, wherein (i) the deviated section is horizontal, or (ii) the deviated section comprises a section that is substantially S-shaped.

18. The method of claim 12, wherein sleeve falls in the wellbore to a position that is at least 45° from vertical and the sphere falls in the wellbore to a position that is at least 70° from vertical.

19. The method of claim 12, wherein sleeve falls in the wellbore to a position that is at least 65° from vertical and the sphere falls in the wellbore to a position that is at least 75° from vertical.

20. The method of claim 12, wherein the sphere falls down below a liquid level within the wellbore.

* * * * *